US006077046A

United States Patent [19]

Kennedy et al.

[11] Patent Number: 6,077,046

[45] Date of Patent: Jun. 20, 2000

[54] GETTER ASSEMBLY HAVING POROUS METALLIC SUPPORT AND ITS USE IN A VACUUM APPARATUS

[75] Inventors: Adam M. Kennedy, Santa Barbara; Timothy S. Romano, Santa Ynez; Steven M. McCabe, Santa Barbara; Larry E. Cobb, Goleta, all of Calif.

[73] Assignee: Raytheon Company, Lexington, Mass.

[21] Appl. No.: 09/009,138

[22] Filed: Jan. 20, 1998

[51] Int. Cl.[7] ..... F04F 11/00

[52] U.S. Cl. ..... 417/48

[58] Field of Search ..... 417/48

[56] References Cited

U.S. PATENT DOCUMENTS

| | | | |
|---|---|---|---|
| 2,824,640 | 2/1958 | Della Porta | 417/48 |
| 3,211,280 | 10/1965 | Malloy | 417/48 |
| 3,737,710 | 6/1973 | Waymouth et al. | 313/174 |
| 4,758,272 | 7/1988 | Pierotti et al. | 75/246 |
| 5,885,682 | 3/1999 | Tanimoto et al. | 428/69 |

*Primary Examiner*—Timothy S. Thorpe
*Assistant Examiner*—Cheryl Tyler
*Attorney, Agent, or Firm*—William C. Schubert; Glenn H. Lenzen, Jr.

[57] ABSTRACT

A getter assembly (38) includes a porous getter element (40) having an outer periphery (44), and a porous, thermally conductive, annular getter support (42) overlying the getter element (40) and contacting the outer surface (44) of the getter element (40). The getter assembly (38) further includes a wall (24) sized so that the annular getter support (42) is received within the wall (24) with a friction fit between an outer periphery (50) of the annular getter support (42) and an inner periphery of the wall (24). The getter support (42) supports the getter element (40) from the wall (24) and provides a thermally conductive pathway from the wall (24) to the getter element (40). The annular getter support (42) is typically a screen, a mesh, a felt, or a foam, which is deformable to conform to the inner wall (24) and to slide into the wall (24) with a friction fit that ensures good thermal contact.

22 Claims, 3 Drawing Sheets

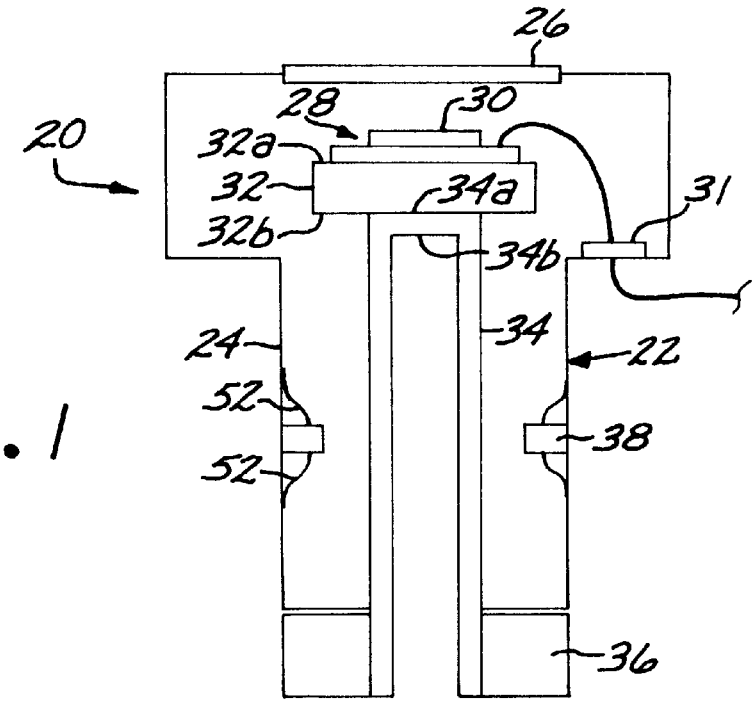
FIG. 1
FIG. 2
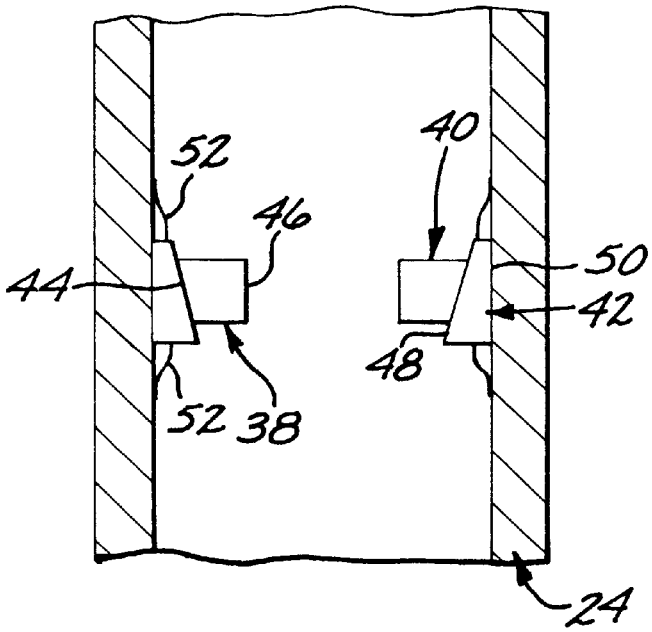

GETTER ASSEMBLY HAVING POROUS METALLIC SUPPORT AND ITS USE IN A VACUUM APPARATUS

BACKGROUND OF THE INVENTION

This invention relates to a getter assembly used in a vacuum apparatus, and, more particularly, to a getter assembly having a porous metallic support.

Many infrared and other types of sensors operate most efficiently and reliably when cooled to a cryogenic temperature, such as about the boiling point of liquid nitrogen, 77K, and are operated in a vacuum to provide thermal insulation for the sensor and to avoid condensation of materials such as water on the sensor. To effect these conditions in service, the sensor is mounted within an evacuated dewar/vacuum enclosure. The dewar/vacuum enclosure typically includes an insulated vacuum housing having a window through which the sensor views an external scene.

The interior of the dewar/vacuum enclosure must remain evacuated and at low pressure before and during service. The enclosure is initially evacuated during manufacture, and thereafter sealed. However, there is a continuous small outgassing of the structure inside the enclosure. To obviate the resulting small increase in gas pressure, getter material is placed inside the vacuum package and activated, effectively forming a chemical vacuum pump. A getter is a material that, when activated, captures gas molecules in the vacuum. The getter absorbs, adsorbs, and/or physically entraps oxygen and other molecules that are outgassed from the interior of the vacuum enclosure over the life of the product.

The getter material is available from commercial sources as a porous sintered ceramic mass that fits inside the enclosure. Due to its sintering method of manufacture, the dimensional tolerances of the sintered getter material are rather large, so that the getter material is not accurately sized to fit into the precisely sized enclosure. The dimensional irregularities would not otherwise create a problem, except for the fact that, after positioning inside the enclosure, the getter material must be heated to an elevated activation temperature falling within a relatively narrow temperature range in order to effect activation. If the temperature reached during the activation heating is too low, the getter material is not properly activated and is not fully effective. If the temperature reached during the activation heating is too high, the getter material may further sinter with an associated reduction in porosity that also leads to a loss of effectiveness.

The inventors have found that heating the getter material in vacuum to a precise activation temperature range in these circumstances is difficult, because the primary heat flow path into the getter material is thermal conduction from the walls of the vacuum enclosure. Due to the dimensional irregularities resulting from the manufacturing method, the getter material does not fit closely against the interior walls and the heat flow path is ill defined and irregular, leading to uncertainty as to whether the required activation temperature is reached in the getter material during a standard heating procedure.

The irregular heating of the getter material during the activation procedure cannot be compensated for by calibration or related techniques, because each piece of getter material is differently dimensioned and consequently has different heat flow properties during heating. The getter material cannot be forced against the inner wall of the vacuum enclosure too tightly so as to achieve good thermal contact, because ceramic particles may be rubbed away from the getter material to reside in the interior of the sealed vacuum enclosure. Such ceramic particles may find their way to the sensor surface and interfere with its sensing function during service.

There is a need for an improved approach to the use of a getter in vacuum packages that results in more certainty in the activation procedure, does not risk contaminating the sensor, allows the getter to operate properly, and is economical. The present invention fulfills this need, and further provides related advantages.

SUMMARY OF THE INVENTION

The present invention provides a getter assembly that is more readily heated to a defined activation temperature range, in a closed evacuated enclosure, than has heretofore been possible. The approach of the invention allows the use of a conventional sintered ceramic getter material prepared by conventional processing. Dimensional variations experienced in the processing are accommodated by the present approach. Thermal conduction to the getter material during activation is through a well-defined thermally conductive pathway. The activation procedure may therefore be accomplished with certainty as to the temperature reached in the getter material.

In accordance with the invention, a getter assembly comprises a getter element, and a porous support which supports the getter element. Preferably, the getter element is a disk or disk-shaped annulus, and the support is an annular collar overlying the getter element and contacting its outer surface. The support is, in turn, received within a vacuum housing with a friction fit between an outer perimeter of the support and an inner perimeter of the housing.

The support is made slightly oversize relative to the inner size of the vacuum housing. The porous nature of the support makes it somewhat compliant and allows it to deform slightly upon insertion to produce a good friction fit with the inner wall of the vacuum housing. This friction fit ensures a close contact between the support and the inner wall of the vacuum enclosure, with a resultant well-defined thermal path from the inner wall of the vacuum enclosure to the support regardless of variations in the dimensions of the getter element. The contact between the metallic support and the metallic housing is metal-to-metal in the preferred embodiment, so that there are no ceramic particles disengaged from the getter assembly when the support is inserted into the interior of the vacuum housing and slid into position during manufacturing. The inner periphery of the metallic support closely conforms to the outer periphery of the getter material, so that the heat flow from the metallic support to the getter material is also well defined.

The support is made of a metal in a physically porous form. Operable forms of the support include a felt, a foam, a screen, and a mesh, with the felt preferred. The support is made of a material such as a metal that will withstand the activation temperature without excessive creep and will withstand operating conditions. Examples of such metals include copper and its alloys, and stainless steel.

The present invention provides an important advance in the art of getter assemblies. The support structure accommodates typical dimensional variations in the sintered getter material so that a precisely defined thermal path is achieved from the wall of the vacuum enclosure to the getter material during activation. Activation is therefore achieved more precisely. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 1 is a schematic sectional view of a dewar/vacuum enclosure;

FIG. 2 is a detail of FIG. 1, illustrating the getter material and the support within the vacuum enclosure;

DETAILED DESCRIPTION OF THE INVENTION

Figure 3A:
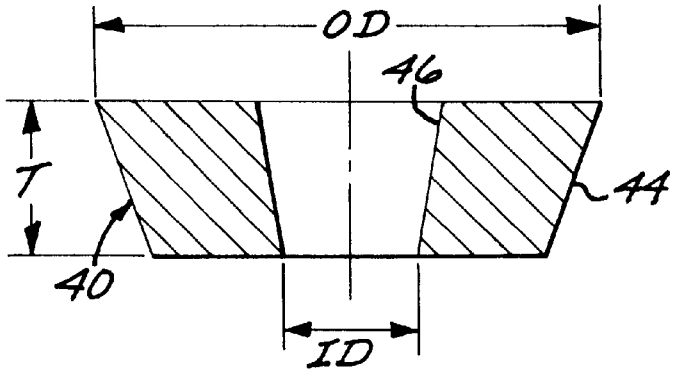
FIGS. 3A and 3B illustrate the getter material, with FIG. 3A presenting a side view and FIG. 3B presenting a plan view.

FIG. 1 depicts a dewar/vacuum enclosure 20 including a dewar body 22 whose interior is evacuated during service. The dewar body 22 has walls 24 with a window 26 in one of the walls 24. An electronic component 28, typically including a sensor 30, faces the window 26. The electronic component 28 is connected to exterior instrumentation (not shown) by wires and a feedthrough 31 extending through the wall 24. The material of construction of the window 26 is selected to transmit radiation of the wavelength sensed by the sensor 30, and such windows and window materials are well known in the art for various wavelengths of interest.

The electronic component 28 and the sensor 30 operate most efficiently at reduced temperatures, with the majority of applications at about 77K, the boiling point of liquid nitrogen. To cool the electronic component 28 to that temperature, it is bonded onto a first end 32*a* of a platform 32, within the vacuum space of the dewar/vacuum enclosure 20. The opposite end 32*b* of the platform 32 is bonded to a top end 34*a* of a hollow cold finger 34. The cold finger 34 supports the platform 32 and thence the electronic component 28 and the sensor 30, and also provides thermal insulation for the platform 32 from a dewar/vacuum enclosure external mounting 36. An interior end 34*b* of the cold finger 34, opposite from the top end 34*a*, is cooled in any operable fashion, such as contact with cold gas, and/or a liquefied gas such as liquid nitrogen, or a mechanical cooler.

In a typical service application, the entire dewar/vacuum enclosure 20 and the electronic component 28 are initially at room temperature. At such time as the electronic component 28 and the sensor 30 are to be used, the interior end 34*b* of the cold finger 34 is cooled. The platform 32 cools by heat flow to the cold finger 34. The electronic component 28 and the sensor 30 are cooled by conduction of heat into the platform 32 and thence to the cold finger 34.

A getter assembly 38 is provided within the interior of the vacuum enclosure 20. The illustrated getter assembly 38 is annular in form. It is located at an intermediate location along the length of the cold finger 34, adhered to the inner surface of the wall 24, or mechanically held by clips 52 or other structure fastened to the dewar wall 24 and contacting the getter assembly 38.

Figure 3B:
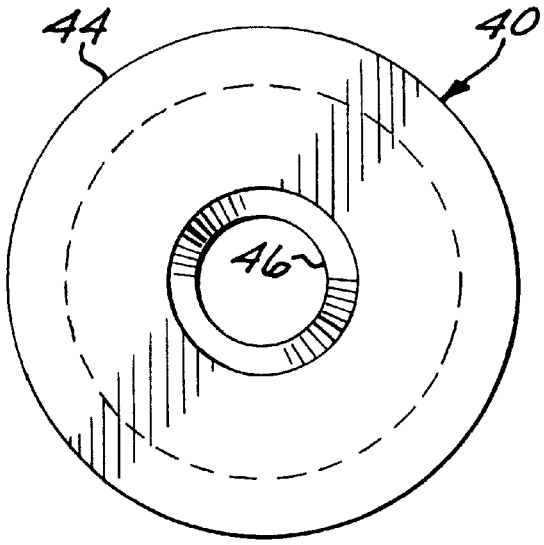

FIG. 2 illustrates one embodiment of the getter assembly 38 in greater detail. The getter assembly 38 includes a getter element 40 and a getter support 42. The getter element 40 is a porous, sintered mass made of a getter material such as, for example, carbon, or zirconium, vanadium, iron, aluminum, titanium, niobium, nickel, or molybdenum, and their mixtures and alloys. A preferred getter is available commercially from SAES Getters/USA, Inc. The getter element 40 may have any operable form. In one embodiment preferred for use within the vacuum enclosure 20 of the sensor system illustrated in FIG. 1, the getter element 40 is a flat circular disk with a tapered outer periphery 44 (to improve manufacturability) and a bore 46 therethrough. As shown in FIGS. 3A and 3B, this getter element 40 is generally annular with an inner diameter ID, an outer diameter OD, and a thickness T. It would be desirable that the OD be a preselected, fixed value, so that it could be received into the interior of the wall 24 of the vacuum enclosure 20 directly and without the need for the getter support 42. However, this is not the case in practice. In a series of eight commercial getter elements received by the inventors and selected at random for measurement, the outer diameter OD ranged from 0.737 inches to 0.766 inches, the inner diameter ID ranged from 0.558 inches to 0.595 inches, and the thickness T ranged from 0.183 inches to 0.209 inches. This variation in dimensions ensures that a portion of the getter element 40 will not touch the wall 24 if the getter element 40 is placed directly inside the wall, decreasing the thermal contact area and therefore degrading the ability to transfer heat to the getter element 40 during activation.

Accordingly, the getter support 42 is provided. The getter support 42 is in the form of an annular collar having a tapered inner periphery 48 to receive therein the tapered outer periphery 44 of the getter element 40. The initial inner diameter of the inner periphery 48 of the getter support 42 is slightly smaller than the expected minimum outer diameter of the getter element 40. The getter support 42 has an outer periphery 50 that is initially slightly larger than the inner diameter of the wall 24.

The getter support 42 is made of a porous, thermally conductive material, preferably in the form of a felt, a foam, a screen, or a mesh, with the felt being most preferred. The felt is an unwoven, pressed mass of metal fibers. The metal fibers must be of a composition that can withstand the temperature reached during activation of the getter element 40, which is preferably about 850° C. Suitable materials include copper and its alloys, and stainless steel, preferably type 304 stainless steel. An operable porous material for use in the getter support 42 is felt material available from Memtec America Corp., Memcorp Engineered Materials Division part number BF07A1910F, which has a porosity of from about 80 to about 90 percent by volume.

The getter support 42 is porous in order to be compliant and deformable. The porosity is preferably from about 50 percent by volume of the total volume of the getter support, to about 98 percent by volume. If the volume fraction of porosity is less than about 50 percent, the getter support 42 becomes too rigid and non-deformable. If the volume fraction of porosity is greater than about 98 percent, there is insufficient thermal conduction during activation. The getter element 40 is assembled to the getter support 42, any resulting loose ceramic particles are removed, and the assembly of getter element 40 and getter support 42 are thereafter inserted into the body 22 of the vacuum enclosure 20. When the assembly is inserted into the getter support 42, the inner periphery 48 of the getter support 42 is deformed slightly to accommodate and conform to the outer periphery 44 of the getter element 40. As discussed above, some variation in the value of the outer periphery 44 of the getter element 40 is expected in practice, and the deformation of the inner periphery 48 of the getter support 42 varies accordingly. Similarly, the outer periphery 50 of the getter support 42 is made slightly larger than the inner diameter of the wall 24, so that, upon insertion of the getter support 42 into the body 22 of the vacuum enclosure 20, the porous material at the outer periphery 50 is deformed slightly to produce a friction fit between the outer periphery of the getter support 42 and the inner diameter of the wall 24.

The result of the close contact between the outer periphery 44 of the getter element 40 and the inner periphery 48 of the getter support 42, and the close contact between the outer periphery 50 of the getter support 42 and the inner diameter of the wall 24, is improved thermal transfer from the wall 24 to the getter element 40. Optionally, one or more clips 52 (FIGS. 1 and 2) or other type of axial support may be spot welded to the inside surface of the wall 24 and positioned to hold the getter support 42 and thence the getter element 40 in place axially along the length of the body 22.

The porous getter support 42 thus performs several functions. It holds the getter element 40 securely and prevents the necessity of any sliding contact during manufacture between the ceramic of the getter element 40 and the metal of the wall 24. Any such sliding contact may produce ceramic particles that might potentially come to rest on the face of the sensor 30 and interfere with its operation. The getter support 42 accommodates variations in the dimensions of the getter element 40. The getter support 42 also provides a predictable, regular thermal contact between the wall 24 and the getter element 40, which has a higher heat transfer rate than would otherwise be the case in the absence of the getter support. When the getter element 40 is to be activated by heating to its activation temperature after assembly inside the vacuum enclosure 20 and its evacuation, heat flows from the wall 24 to the getter element 40. In the absence of the getter support 42, that heat flow is irregular and not readily predictable because of the variations in dimensions of the getter element 40. Where the getter support 42 is present, however, the slightly crushing contact between the getter support 42 and the wall 24, and between the getter support 42 and the getter element 40, produces a uniform, predictable heat flow path from the wall 24, through the getter support 42, and into the getter element 40. The result is that the getter element 40 is reliably and predictably heated to the required activation temperature, which is not possible in the absence of the getter support 42.

Figure 4:
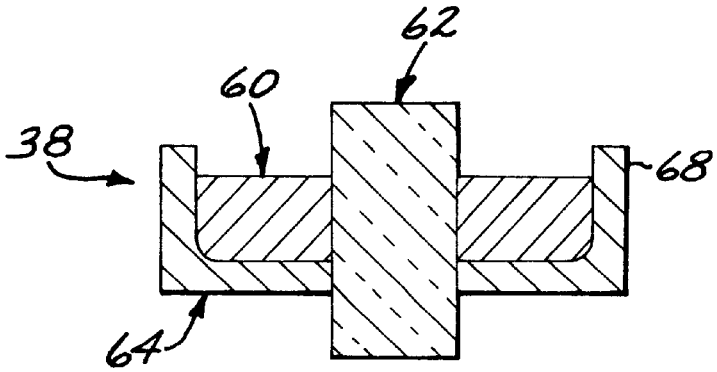
FIG. 4 is a schematic view of a second embodiment of an assembly of getter material and support.
Figure 5:
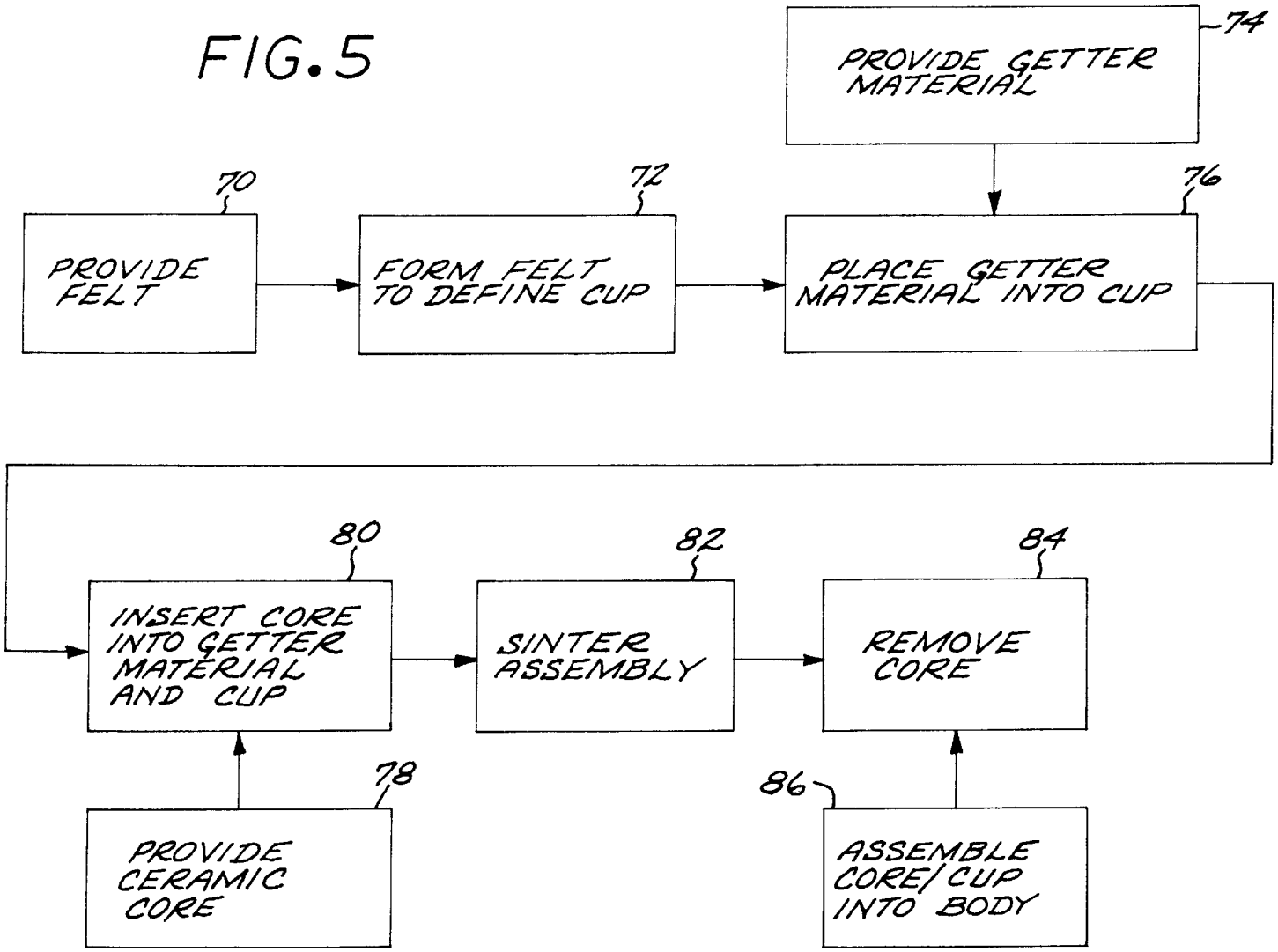
FIG. 5 is a block diagram of a method for preparing the assembly of FIG. 4.

FIG. 4 illustrates another embodiment of the getter assembly 38 which is readily fabricated, and FIG. 5 depicts the method of preparation of this embodiment. A piece of the porous metal such as the porous felt discussed previously is provided, numeral 70. The piece of felt is formed to define a cup 64, numeral 72. An outer diameter 68 of the cup 64 is compliant to form a friction fit with the inner diameter of the wall 24 when the cup 64 is inserted into the body 22 of the vacuum enclosure 20. The getter material, such as discussed previously, is provided, numeral 74. The getter material is placed into the cup 64 of felt material, numeral 76. A ceramic core 62 is provided, numeral 78. The ceramic core 62 is inserted into the inner periphery of the getter material 60, numeral 80. The entire assembly is processed to sinter the getter material, numeral 82. During this sintering, the getter material adheres to the felt metal of the cup 64, forming the getter assembly. The core 62, which was used for manufacturing purposes to define the inner periphery of the getter element 60 and prevent damage to the getter element 60, is removed, numeral 84. In an alternative variation of this process, the cup 64 is formed separately from the getter element 60, and the getter element 60 is thereafter inserted into the cup 64. If desired, the bottom portion of the cup 64 could be removed, but that is generally not necessary because it is porous and gas molecules can diffuse through the porous metal to reach the getter element 60 during service. The assembly is thereafter inserted into the body 22 of the vacuum enclosure, numeral 86.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An assembly, comprising:

a getter element;

a structural element; and a getter support which supports the getter element, the getter support comprising a porous, thermally conductive body disposed between the getter element and the structural element so as to transmit force therebetween.

2. The assembly of claim 1, wherein the getter element comprises a porous body.

3. The assembly of claim 1, wherein the getter element comprises a getter material selected from the group consisting of carbon, and zirconium, vanadium, iron, aluminum, titanium, niobium, nickel, and molybdenum, and their mixtures and alloys.

4. The assembly of claim 1, wherein the getter support comprises a physical form selected from the group consisting of a screen, a mesh, a felt, and a foam.

5. The assembly of claim 1, wherein the getter support comprises a metal selected from the group consisting of copper, and its alloys, and stainless steel.

6. The assembly of claim 1, wherein the porous body of the getter support has from about 50 to about 98 percent by volume of porosity.

7. The assembly of claim 1, wherein the getter support comprises an annular collar in which the getter element is received at an inner perimeter of the collar.

8. The assembly of claim 1, wherein the getter support comprises a cup in which the getter element is received.

9. The assembly of claim 1, wherein the getter element comprises a porous body made of a getter material selected from the group consisting of carbon, and zirconium, vanadium, iron, aluminum, titanium, niobium, nickel, or molybdenum, and their mixtures and alloys, wherein the getter element has an outer perimeter, wherein the getter support comprises a metal selected from the group consisting of copper and its alloys, and stainless steel, and wherein the getter support comprises an annular collar having an inner perimeter into which the outer perimeter of the getter element is received, and an outer perimeter.

10. The assembly of claim 1, further including:

a housing, wherein the getter support is received within the housing.

11. The assembly of claim 10, further including an electronic device contained within the housing.

12. The assembly of claim 1, further including:

a housing, wherein the getter support is received within the housing with a friction fit between an outer perimeter of the getter support and an inner perimeter of the housing.

13. An assembly, comprising:

a porous getter element having an outer surface;

an annular collar overlying the getter and contacting the outer surface of the getter element, the annular collar comprising a porous thermally conductive body; and a housing, wherein the annular collar is received within the housing with a friction fit between an outer perimeter of the annular collar and an inner perimeter of the housing.

14. The assembly of claim 13, wherein the getter element comprises a getter material selected from the group consisting of carbon, and zirconium, vanadium, iron, aluminum, titanium, niobium, nickel, or molybdenum, and their mixtures and alloys.

15. The assembly of claim 13, wherein the getter support comprises a physical form selected from the group consisting of a screen, a mesh, a felt, and a foam.

16. The assembly of claim 13, wherein the getter support comprises a metal selected from the group consisting of copper, and its alloys, and stainless steel.

17. The assembly of claim 13, further including an electronic device contained within the housing.

18. The assembly of claim 1, wherein the porous body of the getter support has from about 50 to about 98 percent by volume of porosity.

19. A method for providing a getter in a vacuum enclosure, comprising the steps of providing a getter element;

providing a getter support comprising a porous, thermally conductive body;

assembling the getter element and the getter support; and thereafter inserting the assembly of getter element and getter support into a vacuum enclosure with the porous, thermally conductive body disposed between the getter element and the vacuum enclosure so as to transmit force therebetween.

20. The method of claim 19, wherein the vacuum enclosure has a wall inner diameter, and wherein an outer diameter of the getter element is greater than the wall inner diameter of the vacuum enclosure, prior to the step of inserting.

21. The method of claim 19, wherein the getter support comprises an annular collar in which the getter element is received at an inner perimeter of the collar.

22. The method of claim 19, wherein the porous body of the getter support has from about 50 to about 98 percent by volume of porosity.

* * * * *